US006572195B1

(12) United States Patent
Lee

(10) Patent No.: US 6,572,195 B1
(45) Date of Patent: Jun. 3, 2003

(54) MECHANISM FOR ADJUSTING DISTANCE BETWEEN ARMRESTS OF OFFICE CHAIR

(76) Inventor: Ching-Yang Lee, No. 12, Fu Kuei Hsin Tsuen, Alley6, Heng Shan Tsuen, Hen Shan Hsiang, Hsin Cuu Hsien (TW)

( * ) Notice: Subject to any disclaimer, the term of this patent is extended or adjusted under 35 U.S.C. 154(b) by 0 days.

(21) Appl. No.: 10/073,163

(22) Filed: Feb. 13, 2002

(51) Int. Cl.[7] ..... B60N 2/46
(52) U.S. Cl. ..... 297/411.37; 297/411.35
(58) Field of Search ..... 297/411.37, 383; 403/320, 321, 322.1, 322.3, 322.4, 374.5, 374.2, 409.1

(56) References Cited

U.S. PATENT DOCUMENTS 5,338,133 A * 8/1994 Tornero ..... 403/321
5,586,811 A * 12/1996 Tornero ..... 297/411.36
5,660,442 A * 8/1997 Tornero ..... 297/411.36
6,409,266 B1 * 6/2002 Chen ..... 297/411.37
2001/0036386 A1 * 11/2001 Chene ..... 403/374.2

* cited by examiner

*Primary Examiner*—Peter M. Cuomo
*Assistant Examiner*—Sarah C. Burnham
(74) *Attorney, Agent, or Firm*—Dennison, Schultz & Dougherty

(57) ABSTRACT

A mechanism for adjusting distance between armrests of office chair includes a manipulating handle, to which a slide member, a base member, and an upper and a lower ratchet washer are sequentially mounted from top to bottom. The two ratchet washers contact with each other either in a tight or a loose relation through control of the manipulating handle. The base member is screwed to an underside of a seat of the chair, and the slide member is slidable relative to the base member with an outer end connected to a lower end of one armrest. By turning the handle in one direction for the two ratchet washers to contact with each other in the loose relation, the slide member can be loosened and adjusted to a desired position relative to the base member and thereby change the distance of a corresponding armrest relative to another armrest.

6 Claims, 6 Drawing Sheets

MECHANISM FOR ADJUSTING DISTANCE BETWEEN ARMRESTS OF OFFICE CHAIR

BACKGROUND OF THE INVENTION

The present invention relates to a mechanism for adjusting distance between armrests of office chair, and more particularly to an adjusting mechanism including a handle that can be turned to loosen two ratchet washers from each other and thereby allows a slide member connected to a lower end of an armrest to move relative to a base member screwed to a seat of the chair, enabling adjustment of the armrest to a desired position relative to another armrest.

Most of the currently available office chairs are provided with armrest-adjusting mechanisms, so that a user may adjust the armrests to the most comfortable vertical and/or horizontal positions relative to the seat of the chair. These adjusting mechanisms all are designed to increase the value of the chairs while they include different numbers of components, provide different functions, and are operated in different manners. It is desirable to develop a mechanism that has simple but novel structure to enable quick adjustment of a distance between armrests of an office chair through easy manipulation of a handle.

SUMMARY OF THE INVENTION

A primary object of the present invention is to provide a mechanism for adjusting distance between armrests of office chair. To achieve this and other objects, the mechanism mainly includes a manipulating handle, to which a slide member, a base member, and an upper and a lower ratchet washer are sequentially mounted from top to bottom. The two ratchet washers contact with each other either in a tight or a loose relation through control of the manipulating handle. The base member is screwed to an underside of a seat of the chair, and the slide member is slidable relative to the base member with an outer end connected to a lower end of one armrest. By turning the handle in one direction for the two ratchet washers to contact with each other in the loose relation, the slide member can be loosened from the base member and laterally adjusted to a desired position relative to the seat and thereby change the distance of a corresponding armrest relative to another armrest.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
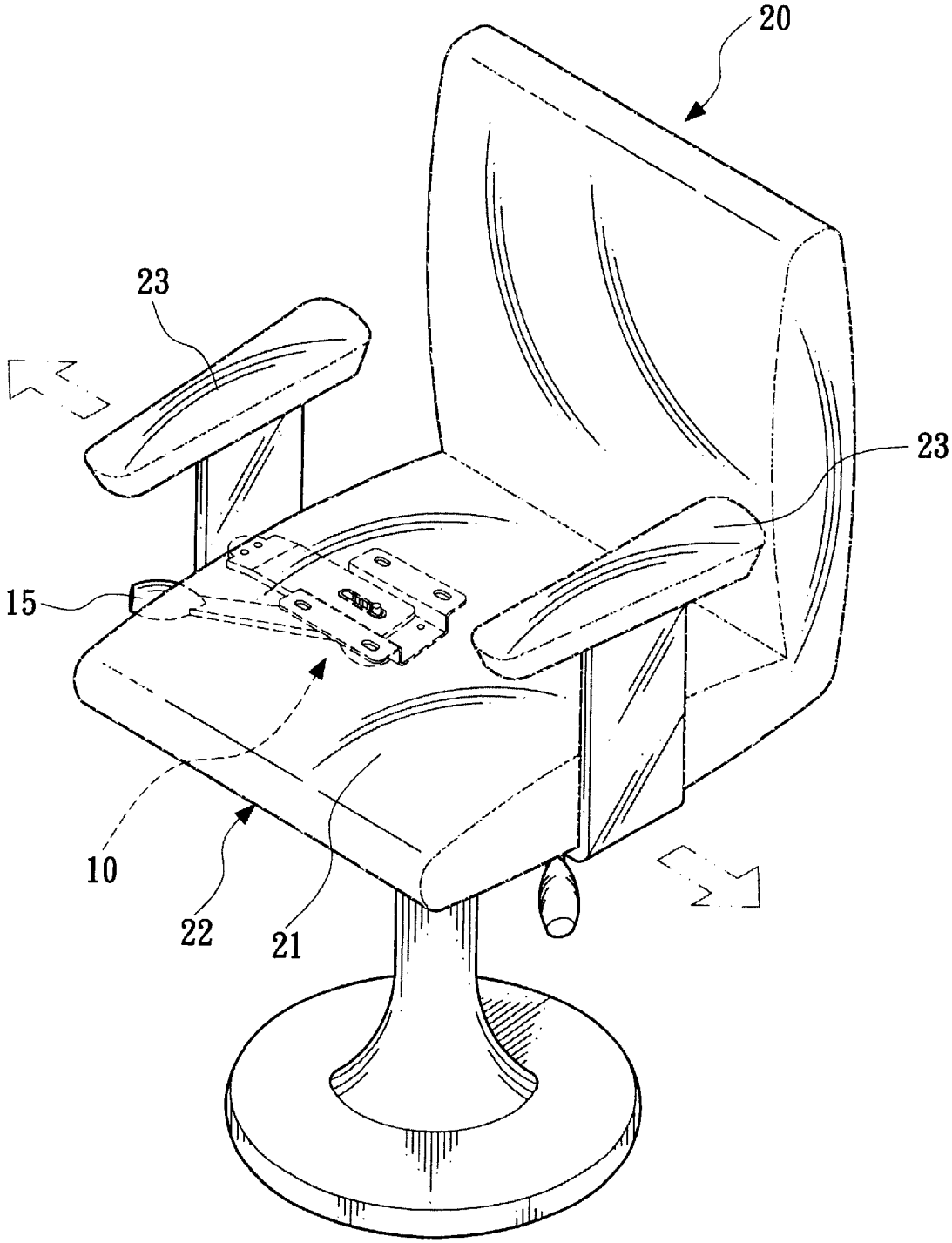
FIG. 1 is a perspective view of an office chair provided with the present invention.

Please refer to FIG. 1. The present invention provides a mechanism 10 mounted to an underside 22 of a seat 21 of an office chair 20 for adjusting a distance between two armrests 23 of the office chair 20. Two sets of the mechanism 10 are provided on each office chair 20 to correspond to the two armrests 23. Since the two sets of mechanisms 10 are structurally and functionally identical, only one of them is described below. The mechanism 10 is designed to laterally (leftward and rightward) slide a slide member horizontally connected to a lower end of the armrest 23, so that the armrest 23 can be moved relative to the seat 21, enabling adjustment of the distance between the two armrests 23 of the office chair 20. The armrest 23 may be of any configuration and can be further associated with other elevating mechanism for adjusting a height of the armrest 23 relative to the seat 21.

Figure 2:
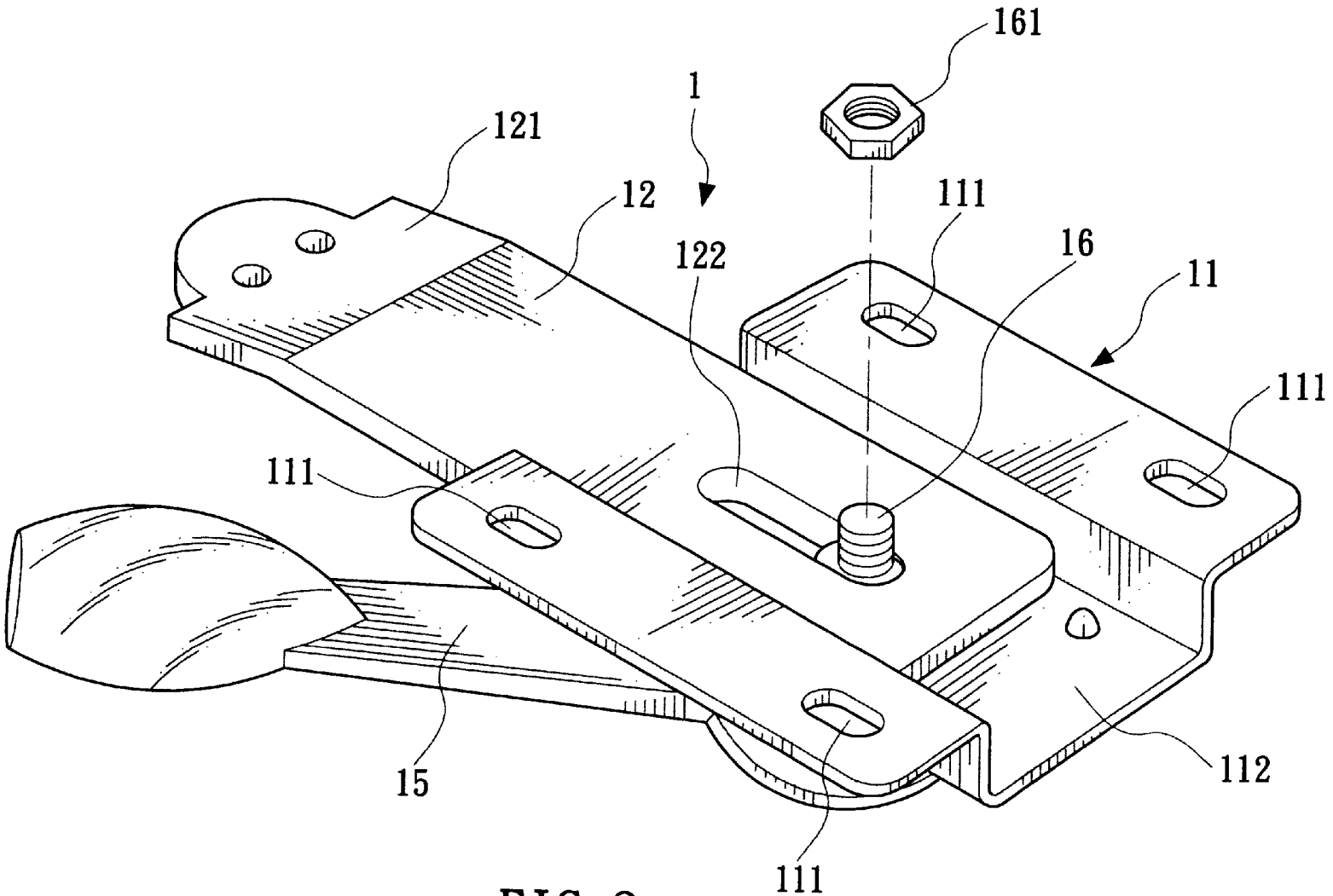
FIG. 2 is an assembled perspective view of the present invention.
Figure 3:
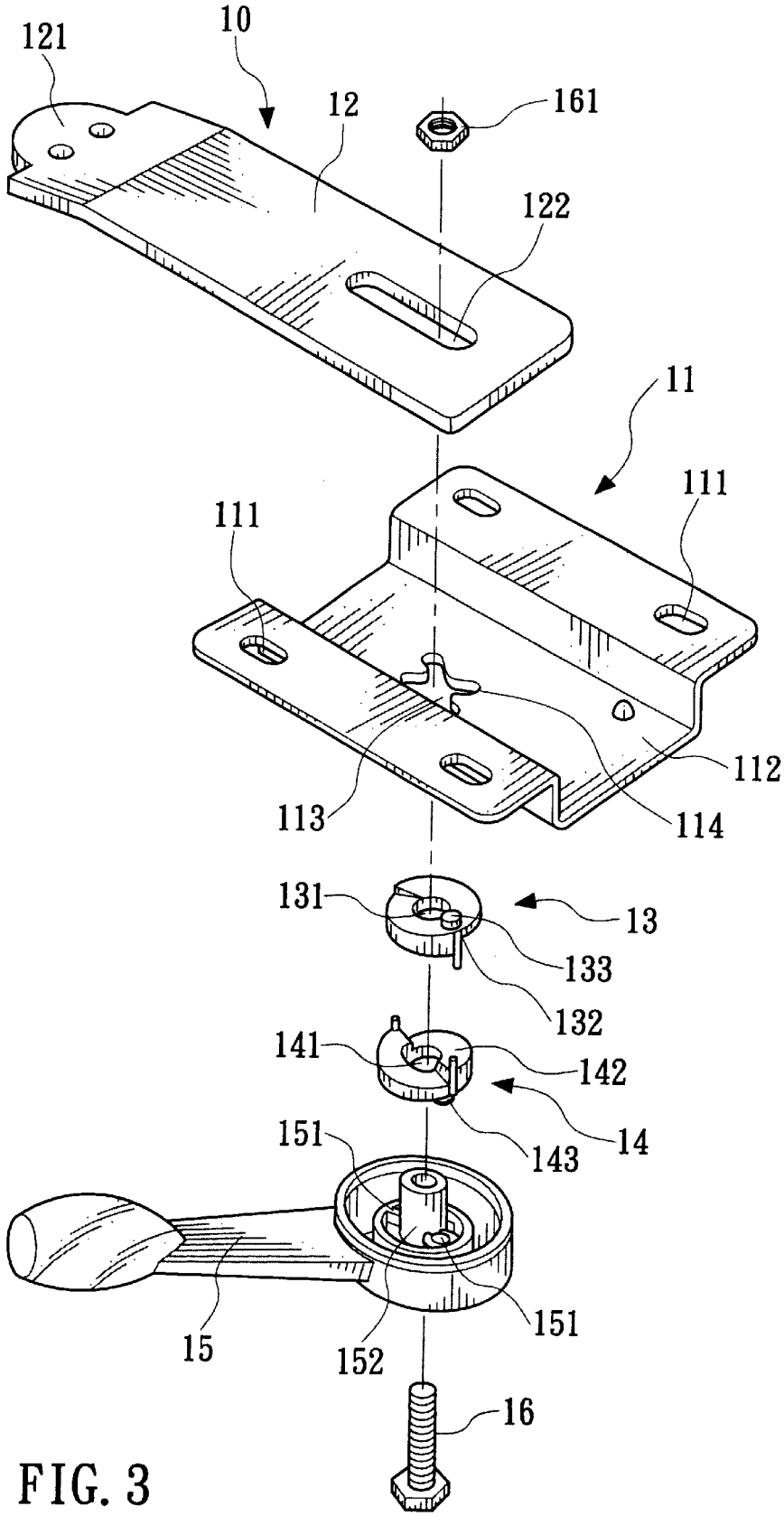
FIG. 3 is an exploded perspective view of the present invention.

As shown in FIGS. 2 and 3, the mechanism 10 of the present invention mainly includes a base member 11, a slide member 12, upper and lower ratchet washers 13 and 14, a manipulating handle 15, and a fastener 16.

The base member 11 is provided at front and rear edges with mounting holes 111 through which fastening means (not shown) can be extended to securely mount the base member 11 to the underside 22 of the seat 21. The base member 11 is so configured that a transverse slide way 112 is formed thereon. A through hole 113 is provided within the slide way 112 at a predetermined position. It is preferable the through hole 113 is provided along an outer peripheral edge with spaced slots 114.

The slide member 12 is connected at an outer end 121 to a lower end of the armrest 23 to be perpendicular to the armrest 23. At least a part of the slide member 12 opposite to the outer end 121 is received in the slide way 112 to laterally slide therein. A long hole 122 is formed on the slide member 12 corresponding to the through hole 113 on the base member 11.

The upper and the lower ratchet washers 13, 14 are provided with central holes 131 and 141, respectively, and are coaxially superposed in the mechanism 10. Contact surfaces of the upper and the lower ratchet washers 13, 14 are complementary ratchet surfaces 132, 142 provided with a plurality of ratchets. When the upper and the lower ratchet washers 13, 14 are rotated relative to each other in two opposite directions, the complementary ratchet surfaces 132, 142 are either contacted with each other in a tight relation, in which the ratchets on the complementary ratchet surfaces 132, 142 contact with one another at high areas thereof to increase an overall height of the superposed ratchet washers 13, 14, or in a loose relation, in which the ratchets on the complementary ratchet surfaces 132, 142 contact with one another at low areas thereof to decrease the overall height of the superposed ratchet washers 13, 14. That is, a space originally occupied between the two ratchet washers 13, 14 is correspondingly increased or reduced in the tight and the loose relations, respectively. The ratchets are correspondingly provided on the complementary ratchet surfaces 132 and 142 without specific limitation in their number. However, these ratchets must be symmetrically arranged relative to the central holes 131, 141, respectively. In FIGS. 2 and 3, there are two ratchets provided on each of the upper and the lower ratchet washers 13, 14. Thus, by turning the two ratchet washers 13, 14 relative to each other in opposite directions by about 180 degrees, the contact between the complementary ratchet surfaces 132, 142 changes either from the tight relation to the loose relation, or from the loose relation to the tight relation.

The upper ratchet washer 13 is provided at a top with an upward boss 133 that is adapted to engage with one of the slots 114 of the through hole 113 on the base member 11 and thereby holds the ratchet washer 13 in place. The lower ratchet washer 14 is provided at a bottom with a downward boss 143 that is adapted to engage with one of many recesses 151 formed in the manipulating handle 15, so that the lower ratchet washer 14 can be rotated with the handle 15. This arrangement allows the lower ratchet washer 14 to rotate relative to the upper ratchet washer 13 in a desired direction even the latter is held in place through engagement of the boss 133 with the slot 114.

The manipulating handle 15 provides an arm of force having a predetermined length for easy rotation thereof. A hollow pivot shaft 152 upward extends from an inner end of the handle 15 by a predetermined height. The above-mentioned recesses 151 are located outside and spaced around the hollow pivot shaft 152.

To assemble the mechanism 10 for use, the fastener 16, which may be, for example, a threaded bolt, is upward extended from a bottom of the hollow pivot shaft 152 of the handle 15 to expose its threads from a top of the hollow pivot shaft 152. The hollow pivot shaft 152 with the bolt 16 received therein is caused to upward extend through the central holes 141, 131 of the lower and the upper ratchet washers 14, 13, as well as the through hole 113 on the base member 11 and the long hole 122 on the slide member 12. Thereafter, a nut 161 is screwed onto the exposed threads of the bolt 16, so that the slide member 12, the base member 11, the upper and the lower ratchet washers 13, 14, and the handle 15 are sequentially locked from top to bottom into one unit. Apart from the fastener 16 and the nut 161, other equivalent means, such as rivets, may also be employed to assemble the mechanism 10 of the present invention.

The upper and the lower ratchet washers 13, 14 sequentially put around the hollow pivot shaft 152 through engagement of their central holes 131, 141 with the shaft 152 are located between the base member 11 and the handle 15. The hollow pivot shaft 152 has a predetermined height that is sufficiently larger than an overall thickness of the base member 11 and the slide member 12. A remaining height of the hollow pivot shaft 152 that is not occupied by the base member 11 and the slide member 12 is preferably larger than a minimum overall height of the upper and the lower ratchet washers 13, 14 (that is, the overall height of the two ratchet washers 13, 14 when the ratchet surfaces 132, 142 contact with each other in the loose relation) but smaller than a maximum overall height of the upper and the lower ratchet washers 13, 14 (that is, the overall height of the two ratchet washers 13, 14 when the ratchet surfaces 132, 142 contact with each other at the tight relation).

After the entire mechanism 10 is completely assembled and mounted to the underside 22 of the seat 21, horizontally turning of the manipulating handle 15 in one direction would enable the lower ratchet washer 14 to upward move the upper ratchet washer 13 and accordingly reduces a space between the upper ratchet washer 13 and the slide member 12, causing the two components to simultaneously tightly attach to and be held in place below and above the base member 11, respectively. In this firmly attached manner, the slide member 12 is prevented from sliding relative to the base member 11, and the armrest 23 connected at a lower end to the outer end 121 of the slide member 12 is in a fixed state for use. To adjust the armrests 23 for them to locate at two lateral sides of the seat 21 with a desired distance between them, simply turn the manipulating handle 15 in a reverse direction and the two ratchet surfaces 142, 132 would contact with each other in the loose relation to reduce the overall height of the upper and the lower ratchet washers 13, 14. At this point, the distance between the upper ratchet washer 13 and the slide member 12 is increased to loosen the slide member 12 from the base member 11. By pushing or pulling the armrest 23, the slide member 12 is guided by the hollow pivot shaft 152 upward extended through the long hole 122 to slide laterally within a range defined by the long hole 122 to a desired position.

Figure 4:
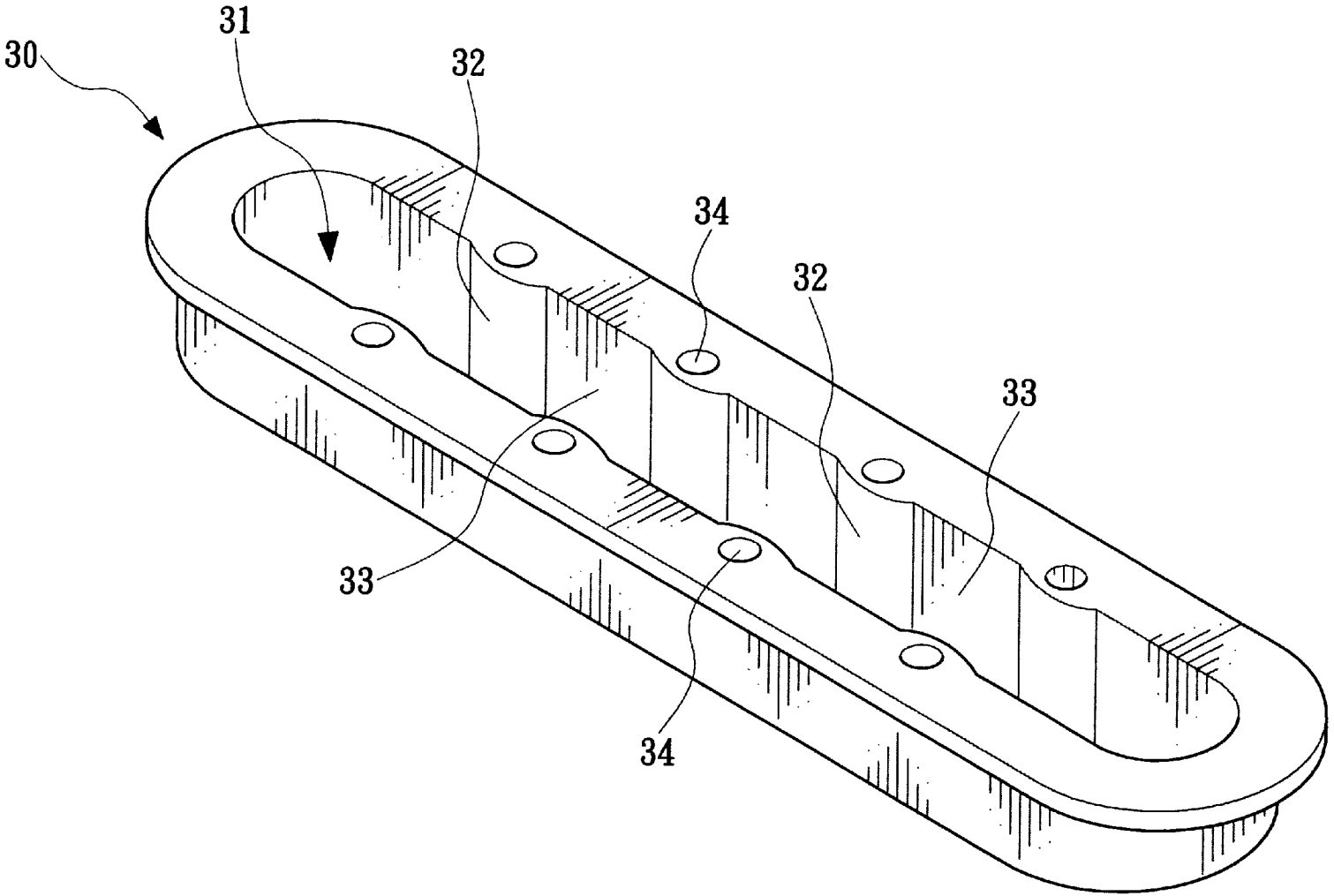
FIG. 4 is a perspective view of a stage guide element included in the present invention.
Figure 5:
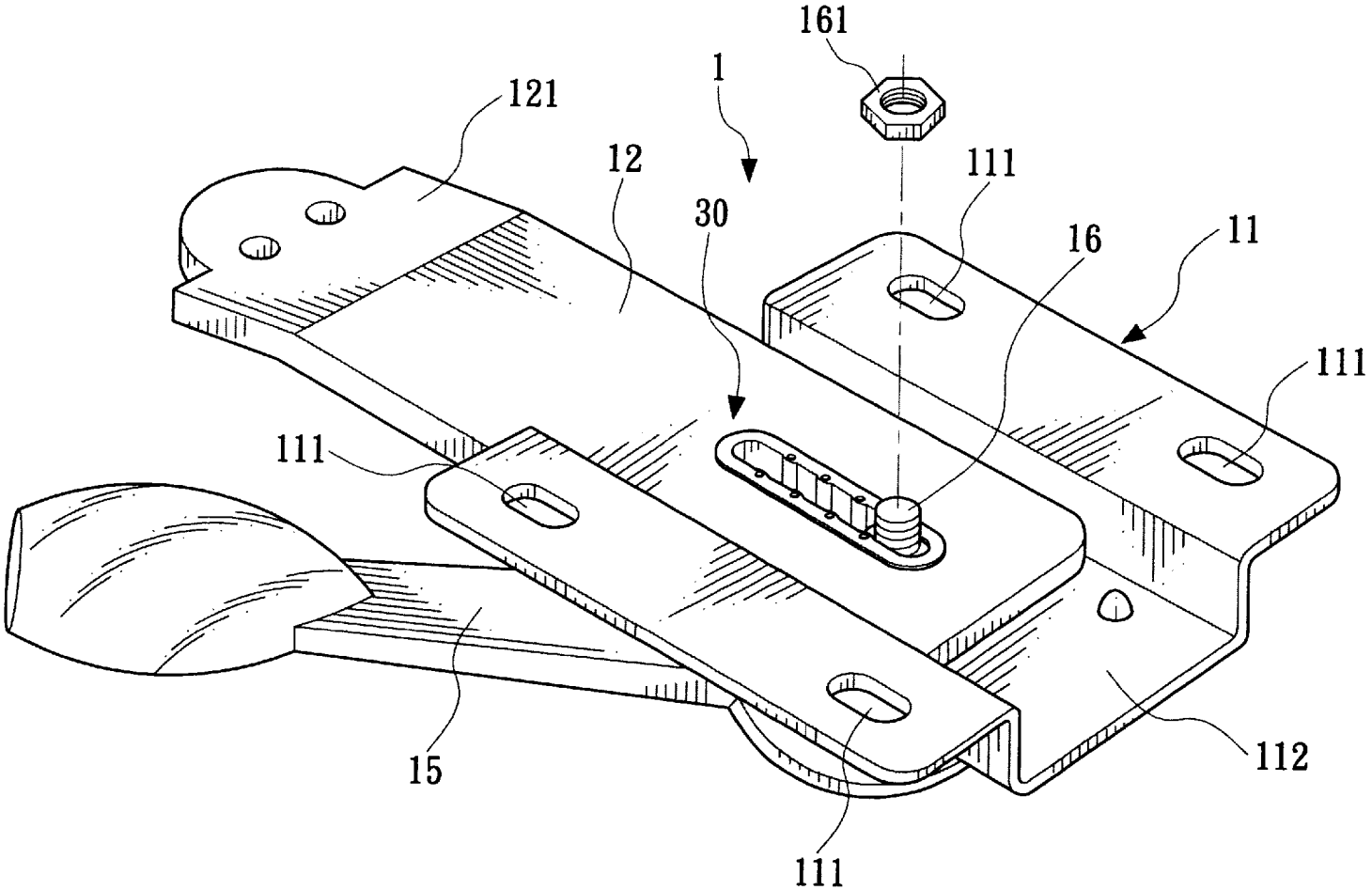
FIG. 5 is an assembled perspective view of the present invention with the stage guide element mounted thereon.

Please refer to FIGS. 4 and 5. A stage guide element 30 may be fitly set in the long hole 122 on the slide member 12. The guide element 30 may be made of a plastic material through molding and defines an inner stage guide way 31. Inner surfaces of two transverse walls of the inner stage guide way 31 are provided with a plurality of spaced pairs of symmetrical lugs 32, so that a plurality of mutually communicable sub-chambers 33 are formed in the inner stage guide way 31. The sub-chambers 33 allow the slide member 12 to be guided by the hollow pivot shaft 152 to laterally slide in the inner stage guide way 31 stage by stage, allowing the slide member 12 to be adjusted more efficiently. Moreover, the stage guide element 30 may be provided at the two transverse walls behind each lug 32 with a hole 34 for the lug 32 to have an increased elasticity, which enables the lugs 32 to divide the inner guide way 31 into multiple stages without hindering a smooth sliding of the slide member 12 over the base member 11.

The base member 11 and the slide member 12 are generally made of metal plate by way of punching. For the slide member 12 to smoothly slide in the slide way 112 of the base member 11, a smooth and wear-resistant plastic sheet may be applied between the slide member 12 and the slide way 112. Alternatively, small dots may be evenly distributed on a contact surface of the plastic sheet with the slide member 12 to reduce a frictional contact of the slide member 12 with the slide way 112. Since these ways are known in the art, they are not discussed in details herein.

Figure 6:
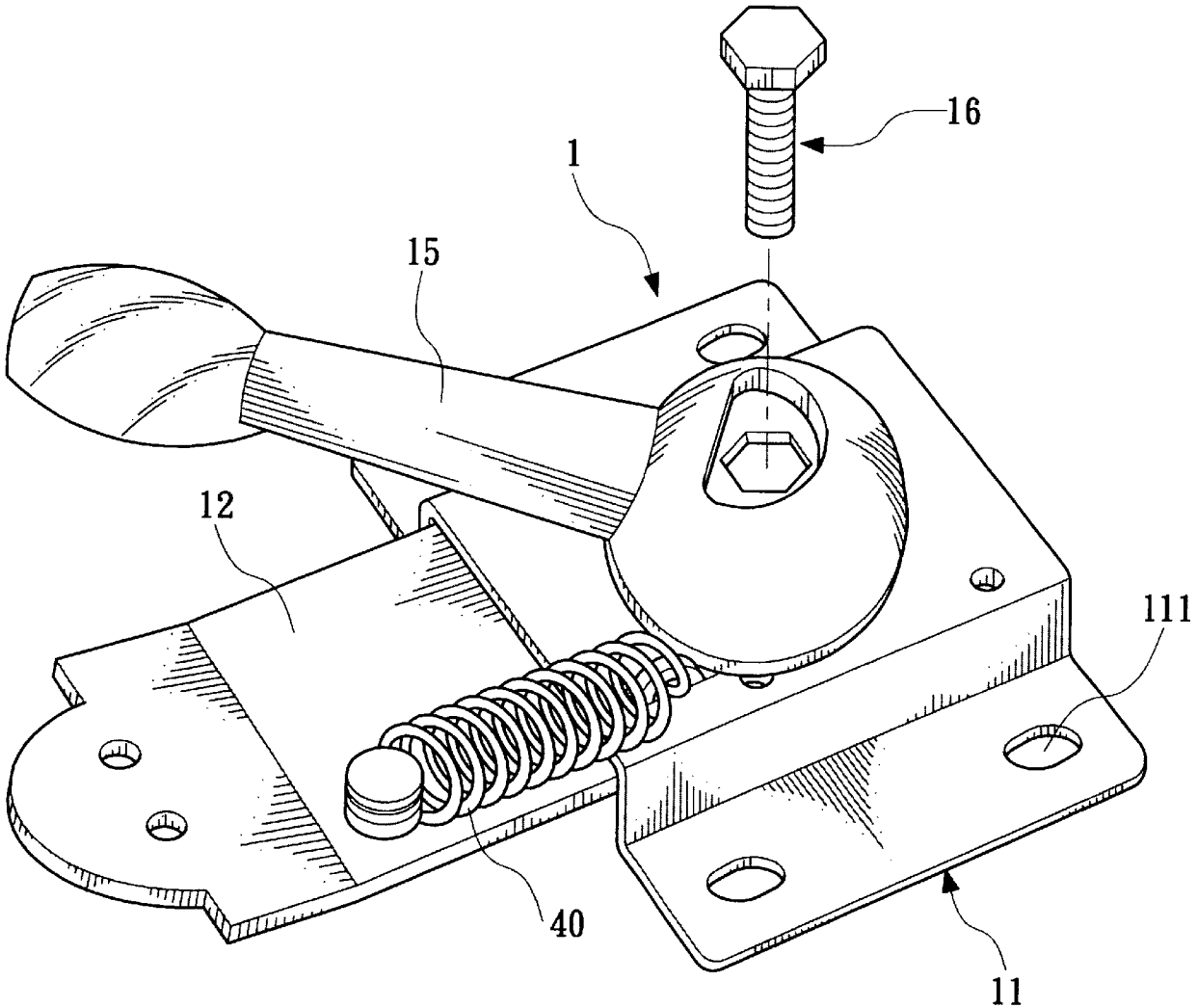
FIG. 6 is an assembled bottom perspective view of the present invention.

A spring 40, such as a tension spring, may be provided between the slide member 12 and the base member 11, as shown in FIG. 6, which is a bottom perspective view of the present invention. When the slide member 12 is laterally pulled outward relative to the base member 11, the spring 40 provides proper restoring force to facilitate returning of the slide member 12 to a home position thereof in the assembled mechanism 10.

What is claimed is:

1. A mechanism for adjusting a distance between armrests of an office chair, said mechanism being mounted to an underside of a seat of said office chair at each lateral side thereof corresponding to each armrest, comprising a base member, a slide member, two complementary upper and lower ratchet washers, a manipulating handle, and a fastener;

said base member being screwed to one lateral side at the underside of said seat, and having a transverse slide way formed therewith, said slide way being provided with a through hole that has a plurality of slots spaced along an outer peripheral edge thereof;

said slide member being connected at an outer end to a lower end of one armrest, at least a part of said slide member opposite to said outer end being slidably received in said slide way of said base member, and a long hole being formed on said slide member corresponding to said through hole on said base member;

said complementary upper and lower ratchet washers being provided with central holes about which said ratchet washers are coaxially superposed; contact surfaces of said upper and said lower ratchet washers being complementary ratchet surfaces having a plurality of ratchets correspondingly provided thereon, such that when said upper and said lower ratchet washers are rotated relative to each other in two opposite directions, said complementary ratchet surfaces contact with each other either in a tight relation, in which said ratchets on said complementary ratchet surfaces contact with one another at high areas thereof to increase an overall height of said superposed ratchet washers, or in a loose relation, in which said ratchets on said complementary ratchet surfaces contact with one another at low areas thereof to decrease the overall height of said superposed ratchet washers; said upper ratchet washer being provided at a top with an upward boss that is adapted to engage with one of said slots of said through hole on said base member and thereby holds said upper ratchet washer in place; and said lower ratchet washer being provided at a bottom with a downward boss that is adapted to engage with said manipulating handle for said lower ratchet washer to rotate along with said manipulating handle;

said manipulating handle providing an arm of force having a predetermined length for easy rotation thereof, a hollow pivot shaft being formed at an inner end of said manipulating handle to upward extend therefrom by a predetermined height, and recesses being spaced outside and around said hollow pivot shaft for said downward boss on said lower ratchet washer to selectively engage with one of said recesses to rotate along with said manipulating handle; and said fastener upwardly extending through said hollow pivot shaft of said manipulating handle to sequentially pass through said central holes of said lower and said upper ratchet washers, said through hole on said base member, and said long hole on said slide member to assemble said handle, said ratchet washers, said base member and said slide member into one unit;

whereby when said manipulating handle is horizontally turned about said hollow pivot shaft in one direction, said lower ratchet washer moves said upper ratchet washer upward and accordingly reduces a space between said upper ratchet washer and said slide member, causing said upper ratchet washer and said slide member to simultaneously tightly attach to and be held in place below and above said base member, respectively, and allowing said armrest connected to said outer end of said slide member to firmly locate in place for use; and when said manipulating handle is turned reversely, said lower ratchet washer returns to contact with said upper ratchet washer at low areas on their contact surfaces to reduce the overall height of said upper and said lower ratchet washers and accordingly increase the distance between said upper ratchet washer and said slide member to loosen said slide member from said base member, allowing said slide member to be guided by said hollow pivot shaft of said manipulating handle to slide laterally within a range defined by said long hole to a desired position and thereby adjust the distance of said armrest relative to another armrest on said office chair.

2. The mechanism for adjusting a distance between armrests of an office chair as claimed in claim 1, wherein said ratchets are correspondingly provided on said contact surfaces of said upper and said lower ratchet washers without specific limitation to the number thereof; and said ratchets are symmetrically arranged relative to said central holes of said upper and lower ratchet washers.

3. The mechanism for adjusting a distance between armrests of an office chair as claimed in claim 1, wherein both said upper and said lower ratchet washers have two ratchets provided on said ratchet surfaces, so that turning of said upper and said lower ratchet washers relative to each other by about 180 degrees enables said complementary ratchet surfaces to contact with each other in the tight relation or the loose relation.

4. The mechanism for adjusting a distance between armrests of an office chair as claimed in claim 1, further comprising a stage guide element fitted in said long hole on said slide member, said stage guide element being made of a plastic material with a predetermined toughness, and being symmetrically provided along inner surfaces of two transverse walls thereof with a plurality of spaced lugs to divide an inner space of said long hole into a plurality of mutually communicable sub-chambers that permit said slide member to slide relative to said base member stage by stage.

5. The mechanism for adjusting a distance between armrests of an office chair as claimed in claim 1, wherein said fastener includes a threaded bolt and a matching nut.

6. The mechanism for adjusting a distance between armrests of an office chair as claimed in claim 1, wherein said fastener includes a rivet.

* * * * *